US007237612B2

(12) United States Patent
Surjaatmadja et al.

(10) Patent No.: US 7,237,612 B2
(45) Date of Patent: Jul. 3, 2007

(54) METHODS OF INITIATING A FRACTURE TIP SCREENOUT

(75) Inventors: Jim B. Surjaatmadja, Duncan, OK (US); Billy W. McDaniel, Duncan, OK (US); Mark Farabee, Houston, TX (US); David Adams, Katy, TX (US); Loyd East, Tomball, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 254 days.

(21) Appl. No.: 10/991,165

(22) Filed: Nov. 17, 2004

(65) Prior Publication Data

US 2006/0102344 A1 May 18, 2006

(51) Int. Cl.
*E21B 43/26* (2006.01)

(52) U.S. Cl. ..... 166/308.1; 166/280.1; 166/280.2; 166/305.1; 166/312

(58) Field of Classification Search ..... 166/308.1, 166/280.1–280.2, 305.1, 312
See application file for complete search history.

(56) References Cited

U.S. PATENT DOCUMENTS

| | | | | |
|---|---|---|---|---|
| 4,108,782 | A * | 8/1978 | Thompson | 507/205 |
| 5,054,554 | A * | 10/1991 | Pearson | 166/280.1 |
| 5,183,109 | A | 2/1993 | Poulsen | |
| 5,249,628 | A | 10/1993 | Surjaatmadia | |
| 5,325,923 | A | 7/1994 | Surjaatmadja et al. | |
| 5,396,957 | A | 3/1995 | Surjaatmadja et al. | |
| 5,499,678 | A | 3/1996 | Surjaatmadja et al. | |
| 5,533,571 | A | 7/1996 | Surjaatmadja et al. | |
| 5,765,642 | A | 6/1998 | Surjaatmadja | |
| 6,047,773 | A | 4/2000 | Zeltmann et al. | |
| 6,364,015 | B1 | 4/2002 | Upchurch | |
| 6,585,040 | B2 | 7/2003 | Hanton et al. | |
| 6,662,874 | B2 | 12/2003 | Surjaatmadja et al. | |
| 2003/0234106 | A1 | 12/2003 | Surjaatmadja | |
| 2004/0206494 | A1 * | 10/2004 | Stephenson et al. | 166/250.1 |

OTHER PUBLICATIONS

T.J. Love, et. al., "Selectively Placing Many Fractures in Openhole Horizontal Wells Improves Production," SPE Paper 50422, 1998.
Halliburton Technical Brochure entitled "Cobra Frac[SM] Service", 2000.
Halliburton Technical Brochure entitled "Surgifrac[SM] Service", 2002.
B.W. McDaniel, et. al., "Evolving New Stimulation Process Proves Highly Effective in Level 1 Dual-Lateral Completion," SPE Paper 78697, Oct. 23, 2002.
Halliburton Technical Brochure entitled "Cobra Jet Frac[SM] Service", Undated.

* cited by examiner

*Primary Examiner*—David Bagnell
*Assistant Examiner*—Giovanna M Collins
(74) *Attorney, Agent, or Firm*—John W. Wustenberg; Baker Botts, L.L.P.

(57) ABSTRACT

Methods of initiating a fracture tip screenout, that comprise pumping an annulus fluid into an annulus, between the subterranean formation and a work string disposed within a wellbore penetrating the subterranean formation, at an annulus flow rate; and reducing the annulus flow rate below a fracture initiation flow point so that the fracture tip screenout is initiated in the one or more fractures in the subterranean formation, are provided. Also provided are methods of fracturing a portion of a subterranean formation and methods of estimating a fracture initiation flow point.

62 Claims, 9 Drawing Sheets

METHODS OF INITIATING A FRACTURE TIP SCREENOUT

BACKGROUND

The present invention relates to subterranean fracturing operations. More particularly, the present invention relates to methods of initiating a fracture tip screenout and of determining the fracture initiation flow point during hydraulic fracturing operations.

Hydrocarbon-producing wells are often stimulated by hydraulic fracturing operations, wherein a fracturing fluid is introduced into a hydrocarbon-producing zone within a subterranean formation at a hydraulic pressure sufficient to create or enhance at least one fracture therein. One hydraulic fracturing technique involves discharging a work string fluid through a jetting tool against the subterranean formation while simultaneously pumping an annulus fluid down the annulus surrounding the work string between a work string and the subterranean formation. The stimulation fluid may be jetted against the subterranean formation at a pressure sufficient to perforate the casing and cement sheath (if present) and create cavities in the subterranean formation. Once the cavities are sufficiently deep, jetting the stimulation fluid into the cavities usually pressurizes the cavities. Simultaneously, the annulus fluid may be pumped into the annulus at a flow rate such that the annulus pressure plus the pressure in the cavities is at or above the fracture initiation pressure so that the cavities may be enlarged or enhanced. As referred to herein, the "fracture initiation pressure" is defined to mean the pressure sufficient to enhance (e.g., extend or enlarge) the cavities. The cavities or perforations are enhanced, inter alia, because the annulus pressure plus the pressure increase caused by the jetting, e.g., pressure in the cavities, is above the required hydraulic fracturing pressure.

As this hydraulic fracturing technique is often used in cases where other portions of the wellbore besides the enhanced fracture are taking fluid, commonly referred to as "fluid loss," it may be important to know the flow rate of the annulus fluid at which the fracture initiation pressure occurs. As the flow rate is being increased, the added flow contributes to an increase in pressure. This pressure increase, in turn, causes an increased fluid loss, since fluid loss is a direct function of the differential pressure between the annulus pressure and the pore pressure in the formation. Further, increasing the flow will eventually allow the pressure inside the perforation cavity to be larger than the fracture initiation pressure, which may cause the cavities to be enlarged or enhanced as discussed above. As referred to herein, the "fracture initiation flow point" is defined to mean the flow rate of the annulus fluid, or other fluid that is experiencing fluid loss, at which the fracture initiation pressure occurs. For instance, if the flow rate exceeds the expected fluids loss at the fracture initiation pressure, then fracture initiation will occur. Therefore, the flow rate needed to combat fluid losses is the fracture initiation pressure.

Generally, the stimulation fluid suspends particulate propping agents, commonly referred to collectively as "proppant," that are placed in the fractures to prevent the fractures from fully closing (once the hydraulic pressure is released), thereby forming "propped fractures" within the formation through which desirable fluids (e.g., hydrocarbons) may flow. The conductivity of these propped fractures may depend on, among other things, fracture width and fracture permeability. The permeability may be estimated by the size of the proppant. To generate sufficient fracture width, however, it may be necessary to obtain a fracture tip screenout in the formation. In a fracture tip screenout, the proppants bridge the narrow gaps at the tip of the fracture and are packed into the fracture, thus restricting flow to the fracture tip, which may terminate the extension of the fracture into the formation, inter alia, because the hydraulic pressure of the stimulation fluid may not be transmitted from the wellbore to the fracture tip.

Being able to control the initiation of a fracture tip screenout may be an important aspect of a successful fracturing operation. Without control of the fracture tip screenout, the fractures may not be packed with proppant as needed, e.g., to have the desired fracture width near the wellbore. Conventionally, to initiate a fracture tip screenout, the flow rate of the fracturing fluid is reduced while increasing proppant concentration therein, with the anticipation that this combination will cause a fracture tip screenout. However, this methodology does not consistently cause fracture tip screenouts. While increasing the proppant concentration and decreasing the flow rate does increase the probability that a fracture tip screenout may occur, this methodology assumes that there is one fracture taking all of the fluid. But, where there are competing fractures, the initiation of a fracture tip screenout may be difficult to control and/or predict using conventional methodologies. For example, in deviated wellbores, where only a portion of the perforations communicate with the dominant fracture that is being extended (when using conventional technologies), fluid is lost (e.g., leaking off) into other portions or fractures in the well besides the dominant fracture. Dependent upon the rate of fluid loss into the formation, these conventional methodologies may not successfully generate a tip screenout in the fracture. Furthermore, the conventional methods cannot predict when the screenout occurs, and, therefore, while it is desirable for the proppant to bridge at the tip of the fracture and pack therein, the bridging of the proppant and thus the screenout may occur anywhere in the fracture. Oftentimes, this may happen near the wellbore, before the high concentration proppant reaches the fracture, causing an undesirable screenout inside the wellbore. If the screenout does not occur at the tip, and the fracture is not gradually filled with proppant afterwards, the fracture may not be packed with proppant as desired.

SUMMARY

The present invention relates to subterranean fracturing operations. More particularly, the present invention relates to methods of initiating a fracture tip screenout and of determining the fracture initiation flow point during hydraulic fracturing operations.

In one embodiment, the present invention provides a method of initiating a fracture tip screenout in one or more fractures in a subterranean formation, comprising pumping an annulus fluid into an annulus, between the subterranean formation and a work string disposed within a wellbore penetrating the subterranean formation, at an annulus flow rate; and reducing the annulus flow rate below a fracture initiation flow point so that the fracture tip screenout is initiated in the one or more fractures in the subterranean formation.

In another embodiment, the present invention provides a method of fracturing a portion of a subterranean formation comprising jetting a stimulation fluid against the portion of the subterranean formation; pumping an annulus fluid into an annulus, between the subterranean formation and a work string disposed within a wellbore penetrating the subterranean formation, at an annulus flow rate at or above the fracture initiation flow point so that one or more fractures are created in the portion of the subterranean formation; and reducing the annulus flow rate below a fracture initiation flow point so that a fracture tip screenout is initiated in the one or more fractures in the portion of the subterranean formation.

In yet another embodiment, the present invention provides a method of estimating a fracture initiation flow point comprising measuring an annulus flow rate of an annulus fluid over time; measuring an annulus pressure of the annulus fluid over time; determining a fracture initiation flow point based on the annulus flow rate and the annulus pressure.

The features and advantages of the present invention will be readily apparent to those skilled in the art upon a reading of the description of the specific embodiments that follows.

BRIEF DESCRIPTION OF THE DRAWINGS

A more complete understanding of the present disclosure and advantages thereof may be acquired by referring to the following description taken in conjunction with the accompanying drawings, wherein.

Figure 1A:
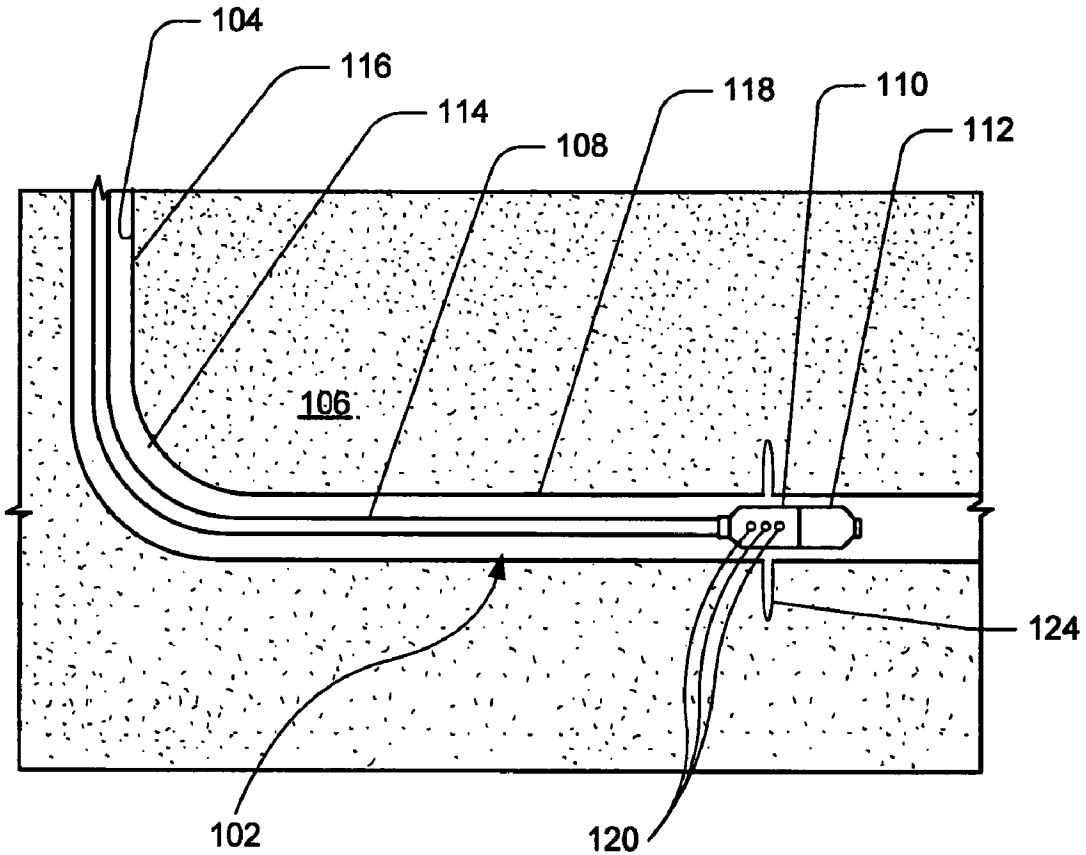
FIG. 1A and FIG. 1B are schematic diagrams illustrating a stimulation system creating cavities in a horizontal wellbore in a portion of a subterranean formation in accordance with the methods of the present invention.

While the present invention is susceptible to various modifications and alternative forms, specific exemplary embodiments thereof have been shown by way of example in the drawings and are herein described in detail. It should be understood, however, that the description herein of specific embodiments is not intended to limit or define the invention to the particular forms disclosed, but on the contrary, the intention is to cover all modifications, equivalents, and alternatives falling within the spirit and scope of the invention as defined by the appended claims.

DESCRIPTION

The present invention relates to subterranean fracturing operations. More particularly, the present invention relates to methods of initiating a fracture tip screenout and of determining the fracture initiation flow point during hydraulic fracturing operations.

In some embodiments, the present invention provides methods of determining a fracture initiation flow point in a portion of a subterranean formation penetrated by a wellbore during a hydraulic fracturing operation. In other embodiments, the present invention may provide methods of initiating a fracture tip screenout in a fracture in a portion of a subterranean formation during a hydraulic fracturing operation. In certain embodiments, the methods of the present invention may permit, inter alia, an operator to initiate a fracture tip screenout on demand from the surface. A variety of hydraulic fracturing operations may be conducted in accordance with the present invention. Generally, the hydraulic fracturing operations of the present invention involve the co-injection of an annulus fluid into an annulus between a work string and a subterranean formation with the jetting of a stimulation fluid against a portion of the subterranean formation penetrated by the wellbore.

Generally, the stimulation fluids that may be utilized in accordance with the methods of the present invention may be any oil-based or water-based fluids suitable for use in hydraulic fracturing operations. In some embodiments, the stimulation fluid may be gelled, wherein the stimulation fluid comprises a suitable gelling agent, such as galactomannan gums, cellulose derivatives (e.g., hydroxyethylcellulose), or other polysaccharides (e.g., succinoglycan). In certain embodiments, the stimulation fluid may be a crosslinked gel, wherein the gelling agent contained therein is crosslinked by a suitable crosslinking agent. In other embodiments, the stimulation fluid may be a linear gel. In some embodiments, the stimulation fluid may be foamed using a gas, such as carbon dioxide or nitrogen. A variety of additional additives may be included in the stimulation fluid as desired, including, but not limited to, surfactants, acids, foaming agents, foam stabilizers, gel breakers, fluid loss control additives, and additional additives known to those skilled in the art. One of ordinary skill in the art with the benefit of this disclosure will be able to determine the appropriate stimulation fluid for a particular application.

A variety of annulus fluids may be utilized in accordance with the methods of the present invention for stimulating subterranean formations, including, but not limited to, water-based and oil-based fluids. In some embodiments, the annulus fluid may be gelled, wherein the annulus fluid comprises a suitable gelling agent, such as galactomannan gums, cellulose derivatives (e.g., hydroxyethylcellulose), or other polysaccharides (e.g., succinoglycan). In certain embodiments, the annulus fluid may be a crosslinked gel, wherein the gelling agent contained therein is crosslinked by a suitable crosslinking gent. In other embodiments, the annulus fluid may be a linear gel. In some embodiments, the annulus fluid may be foamed using a gas, such as carbon dioxide or nitrogen. A variety of additional additives may be included in the annulus fluid as desired, including, but not limited to, surfactants, foaming agents, acids, foam stabilizers, gel breakers, fluid loss control additives, and additional additives known to those skilled in the art. In some embodiments, the annulus fluid may be the same as the stimulation fluid. One of ordinary skill in the art with the benefit of this disclosure will be able to determine the appropriate annulus fluid for a particular application.

In one embodiment, the workstring is used to convey the stimulation fluid. Generally, the stimulation fluid may be diluted with the annulus fluid downhole, commonly referred to as "annulus fluid dilution." As previously mentioned, the hydraulic fracturing operations of the present invention generally involve the co-injection of the annulus fluid into the annulus between a work string and a wall of a wellbore, or a casing, with the jetting of a stimulation fluid against a portion of the subterranean formation penetrated by the wellbore. As the annulus fluid flows down through the annulus, a portion of the annulus fluid may be used to replace fluid losses to other areas of the wellbore, and, generally, a small remainder of annulus fluid may be carried by and/or mixed with the stimulation fluid from the annulus towards the intended area of the subterranean formation. In general, annulus fluid dilution may in the range from about 0% to about 1,000% dependent on a number of factors, including the stimulation the rate requirement. In some embodiments, the annulus fluid dilution may be in the range from about 5% to about 15%. In some embodiments, annulus fluid dilution may be about 10%. When the dilution is large (such as more than 25%) the annulus fluid becomes a contributor towards the stimulation, thus becoming a part of the stimulation fluid.

Optionally, proppant may be included in the annulus fluid, the stimulation fluid, or both. Among other things, proppant may be included to prevent fractures formed in the subterranean formation from fully closing once the hydraulic pressure is released. A variety of suitable proppant may be used including, but not limited to, sand, bauxite, ceramic materials, glass materials, nut hulls, polymer beads, and the like. In certain embodiments, the proppant may be coated with resins, tackifiers, or both, if desired, e.g., to consolidate the proppant downhole. If used, the resins and/or tackifiers should not undesirably interact with the proppant are any other components of the stimulation and/or annulus fluid. In some embodiments, proppant should be included in at least a portion of the stimulation fluid in the workstring. In other embodiments, proppant may be included in at least a portion of the annulus fluid. In yet other embodiments, proppant may be included in at least a portion of the annulus fluid and a portion of the stimulation fluid in the workstring. One of ordinary skill in the art, with the benefit of this disclosure, should know the appropriate amount and type of proppant to include in the annulus fluid and/or stimulation fluid for a particular application.

Figure 1B:
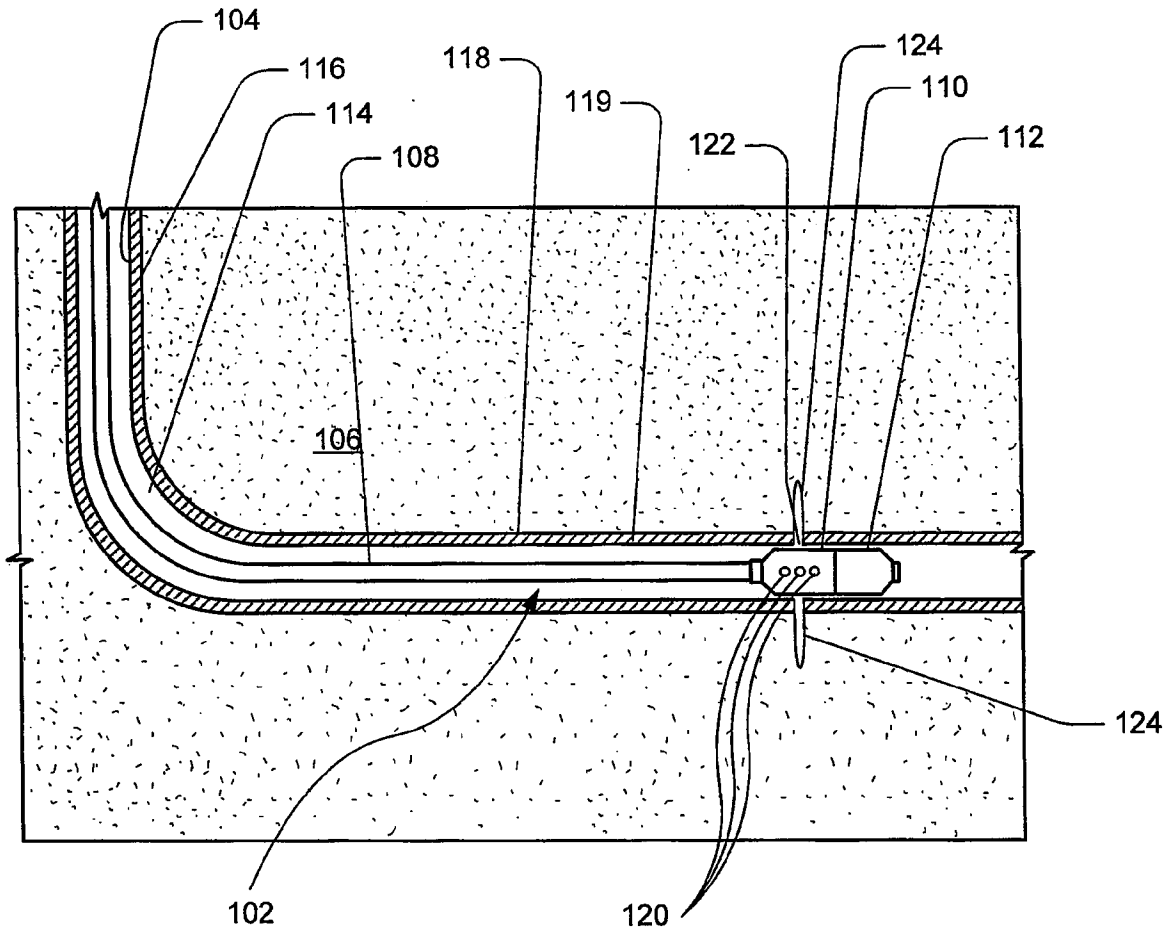

Referring now to FIGS. 1A and 1B, stimulation system 102 in accordance with an embodiment of the present invention is shown installed in wellbore 104 that penetrates subterranean formation 106. Wellbore 104 includes generally vertical portion 116, which extends to the ground surface (not shown), and generally horizontal portion 118, which extends into subterranean formation 106. Even though FIGS. 1A and 1B depict wellbore 104 as a deviated wellbore with generally horizontal portion 118, the methods of the present invention may be performed in generally vertical, inclined, or otherwise formed portions of wells. In addition, wellbore 104 may include multilaterals, wherein wellbore 104 may be a primary wellbore having one or more branch wellbores extending therefrom, or wellbore 104 may be a branch wellbore extending laterally from a primary wellbore. Furthermore, wellbore 104 may be openhole as shown in FIG. 1A or lined with casing 119 as shown in FIG. 1B. In FIG. 1B, casing 119 extends from the ground surface (not shown) into wellbore 104 that penetrates subterranean formation 106. Casing 119 may or may not be cemented to subterranean formation 106 with a cement sheath.

Simulation system 102 includes work string 108, in the form of piping or coiled tubing, jetting tool 110 coupled at an end thereof, and optional valve subassembly 112 coupled to an end of jetting tool 110. Annulus 114 is formed between subterranean formation 106 and work string 108, jetting tool 110, and valve subassembly 112.

One end of work string 108 is coupled to one end of jetting tool 110. Jetting tool 110 may be any suitable assembly for use in subterranean operations through which a fluid may be jetted at high pressures. Generally, jetting tool 110 should have a plurality of ports 120 extending therethrough for discharging a stimulation fluid out of jetting tool 110 against subterranean formation 106. In some embodiments, the plurality of ports 120 may form discharge jets as a result of a high pressure stimulation fluid being forced out of relatively small ports. In other embodiments, jetting tool 110 may have fluid jet forming nozzles (not shown) connected within the plurality of ports 120. In certain embodiments, the plurality of ports 120 may be disposed in a single plane that may be positioned at a predetermined orientation with respect to the longitudinal axis of jetting tool 110. Such orientation of the plane of the plurality of ports 120 may coincide with the orientation of the plane of minimum principal stress (or in the direction of maximum stress) in the formation to be fractured relative to the longitudinal axis of the wellbore penetrating the formation. Examples of suitable jetting tools are described in commonly owned U.S. Pat. Nos. 5,765,642 and 5,499,678, the disclosures of which are incorporated herein by reference in their entirety.

Valve subassembly 112 may be connected to the other end of jetting tool 110 and may be closed during hydraulic fracturing operations to cause the flow of the stimulation fluid to discharge through jetting tool 110. While valve subassembly is optional, it may be included to allow reverse recirculation through the work string, such as during cleanouts, screenouts, and equipment failures. In certain embodiments, valve subassembly may be a tubular, ball-activated valve, such as those described in U.S. Pat. Nos. 5,765,642 and 5,499,678.

Those of ordinary skill in the art will understand that a variety of other components may be included in stimulation system 102 as desired, including centralizers, blow out preventers, strippers, tubing valves, anchors, seals, and the like. Since these components are conventional, they are not shown, nor will they be described in detail.

In operation, jetting tool 110 should be positioned in wellbore 104 adjacent to the portion of subterranean formation 106 to be fractured. As shown in FIG. 1A, once jetting tool 110 has been so positioned, a stimulation fluid may be pumped down through work string 108, into jetting tool 110, and out through the fluid jet forming nozzles in ports 120 against the portion of subterranean formation 106 to be fractured. As will be understood by those of ordinary skill in the art, with the benefit of this disclosure, valve subassembly 112 should be closed to allow the discharge of the stimulation fluid through ports 120. In a cased wellbore, as shown in FIG. 1B, the stimulation fluid must first be discharged against the interior surface of casing 119 causing perforations 122 to be formed through casing 119 and a cement sheath if present. Once perforations 122 through casing 119 and a cement sheath are formed, the stimulation fluid may be jetted out through the fluid jet forming nozzles in ports 120, through perforations 122 in casing 119, and against the portion of subterranean formation 106 to be fractured. A larger amount of stimulation fluid may be required for a cased wellbore, inter alia, due to the difficulty in forming perforations in casing 119.

The pumping rate of the stimulation fluid should be sufficient so that the pressure of the stimulation fluid jetted through ports 120 reaches a pressure sufficient to perforate casing 119 as needed and create cavities 124 in the portion of subterranean formation 106 to be fractured. In some embodiments, the stimulation fluid may be jetted at a pressure sufficient to create a flow rate of the stimulation fluid exiting jetting tool 110 of up to about 650 ft/sec. In some embodiments, the pressure of the stimulation fluid exiting jetting tool 110 may cause microfractures in the subterranean formation that extend from cavities 124. The pressure required to form a cavity in a particular formation may depend, inter alia, upon the formulation of the stimulation fluid, formation characteristics and conditions, and other factors known to those skilled in the art.

The high velocity stimulation fluid jetting into annulus 114 and against subterranean formation 106 typically causes drastic reductions in pressure surrounding the stimulation fluid stream (based on the well known Bernoulli principle), which may eliminate the need for isolation packers. Furthermore, the stimulation fluid is confined in cavities 124, inter alia, due to the maintenance of the annulus pressure caused by the co-injection of the annulus fluid, as will be discussed in more detail below. As cavities 124 become sufficiently deep, the contained stimulation fluid should pressurize cavities 124.

Figure 2:
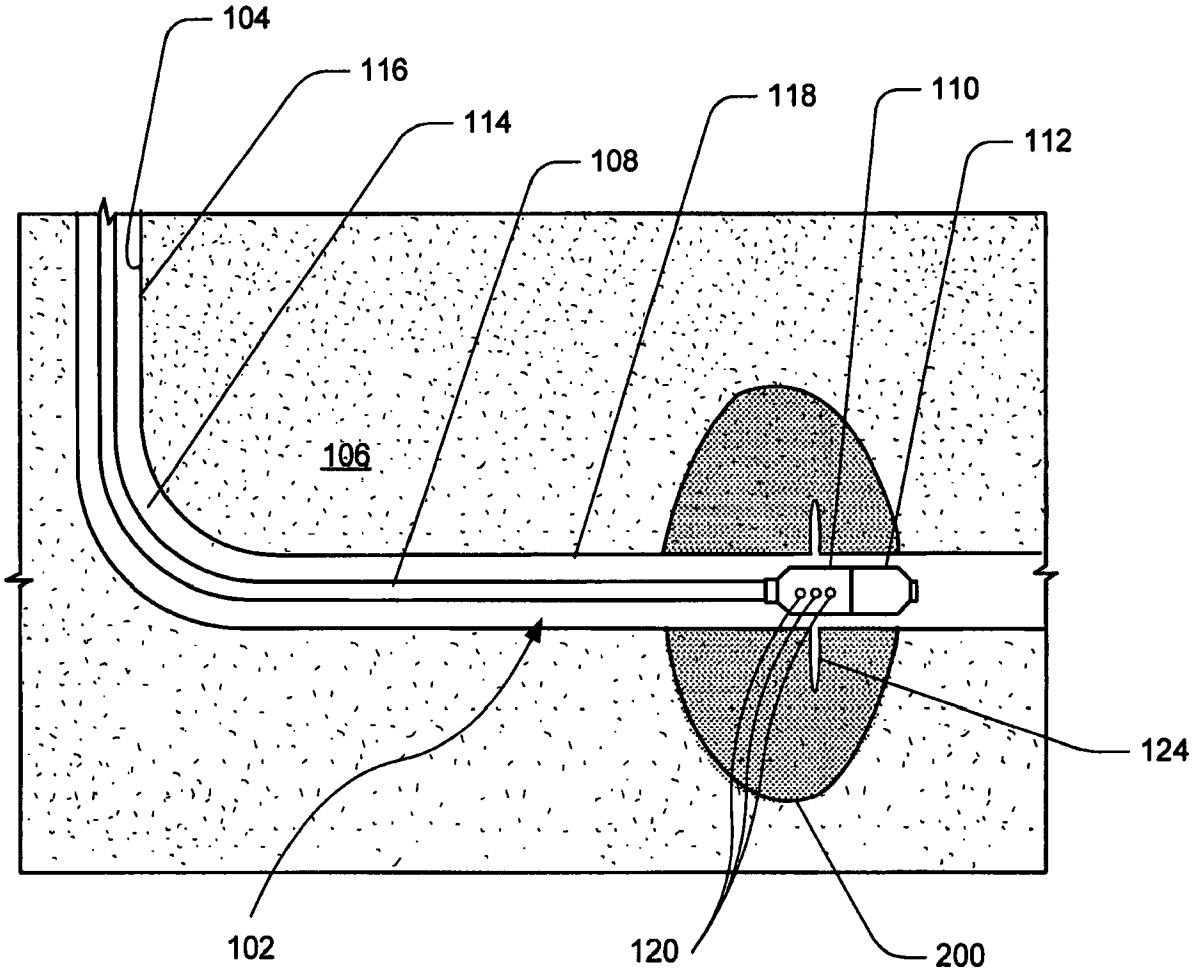
FIG. 2 is a schematic diagram illustrating the creation of fractures in a portion of a subterranean formation wherein the plane of the fractures is longitudinal or parallel to the wellbore axis.
Figure 3:
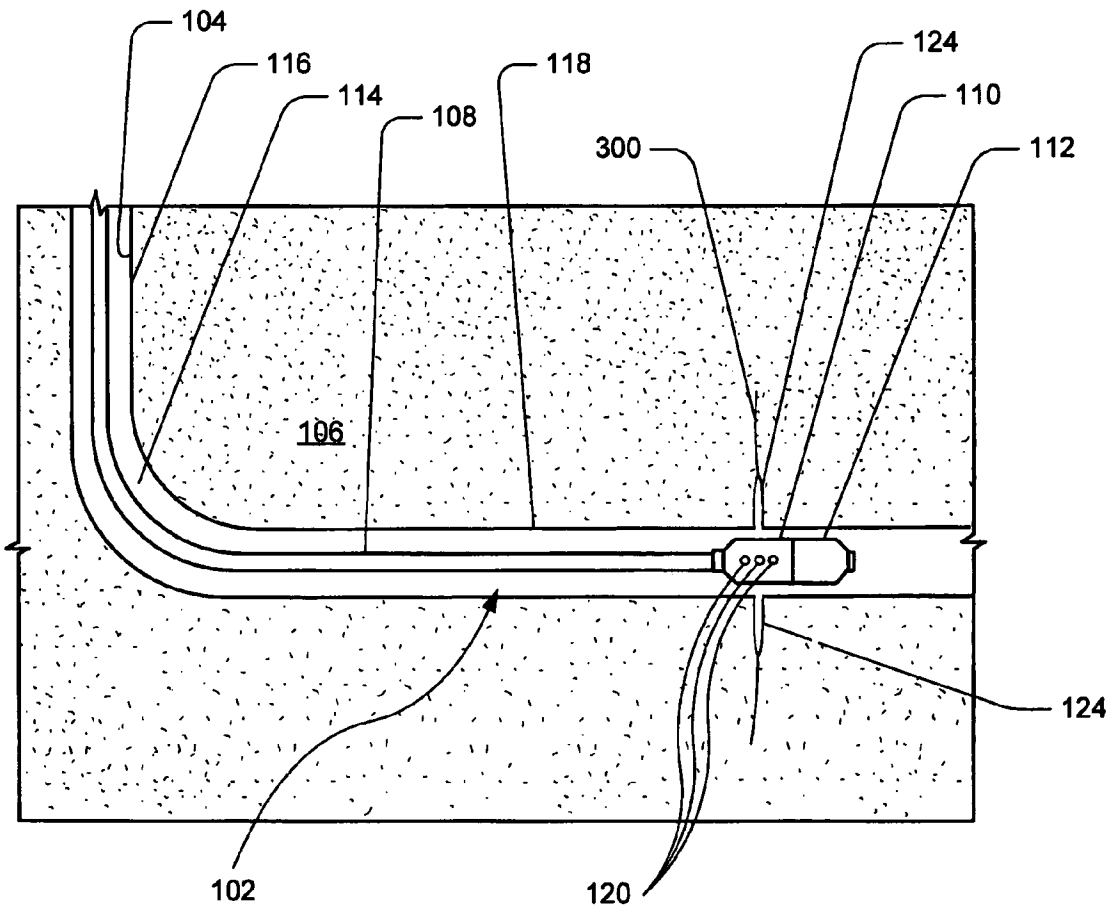
FIG. 3 is a schematic diagram illustrating the creation of fractures in a portion of a subterranean formation wherein the plane of the fractures is perpendicular to the wellbore axis.

Simultaneously with the jetting of the stimulation fluid against the portion of subterranean formation 106 to be fractured, an annulus fluid may be pumped into annulus 114. In some embodiments, a portion of the annulus fluid may enter cavities 124. In these embodiments, as the annulus fluid flows down through annulus 114, the annulus fluid may be carried by and/or mixed with the stimulation fluid from annulus 114 towards and into cavities 124, thereby diluting the stimulation fluid with the annulus fluid. To generate the desired stimulation of subterranean formation 106, the flow rate of the annulus fluid may be increased to a rate at or above the fracture initiation flow point such that downhole pressures are at or above the fracture initiation pressure. By pumping the annulus fluid into annulus 114, the pressure in annulus 114, referred to herein as the "annulus pressure," should increase. When the flow rate of the annulus fluid, referred to herein as the "annulus flow rate" is at or above the fracture initiation flow point, cavities 124 may be enhanced. In some embodiments, the enhancement of cavities 124 may be in the form of one or more fractures that extend into subterranean formation 106. In some embodiments, the one or more fractures forms at least one longitudinal fracture 200, as shown in FIG. 2, that extends in an essentially vertical plane that is approximately longitudinal or parallel to the axis of wellbore 104. In other embodiments, the one or more fractures forms at least one transverse fracture 300, as shown in FIG. 3, that extends in an essentially vertical plane that is approximately perpendicular to the axis of wellbore 104.

The enhancement of cavities 124 may occur when the annulus flow rate exceeds the fracture initiation flow point such that the downhole pressures are at or above the fracture initiation pressure, inter alia, because the annulus pressure plus the pressure in cavities 124 is at or exceeds the hydraulic fracturing pressure of the portion of subterranean formation 106 to be stimulated. Generally, the annulus flow rate should be controlled so that the annulus pressure alone is less than or equal to the hydraulic fracturing pressure of subterranean formation 106. The hydraulic fracturing pressure may vary based on a number of factors, including formation characteristics and conditions and other factors known to those skilled in the art.

The present invention provides methods of determining the fracture initiation flow point, which is the necessary flow rate of the fluid being partially lost to other fractures or unintended areas so that the downhole pressures are at or above the fracture initiation pressure. In some embodiments, the fluid being partially lost to other fractures or unintended areas is the annulus fluid. According to the methods of the present invention an annulus flow rate and an annulus pressure should be measured over time during the fracturing operation. Based on the annulus flow rate and the annulus pressure, the fracture initiation flow point may be determined. A fracturing curve should be plotted, wherein the fracturing curve is the annulus pressure versus the annulus flow rate. A friction curve also should be plotted, wherein the friction curve is based on the particular annulus fluid and the pipe geometry (e.g., work string geometry). The friction curve is generally the plot of annulus pumping pressure at a constant downhole pressure equaling the fracturing pressure, thus equaling the fracture gradient times depth minus the hydrostatic head plus friction loss. The friction curve is a plot of pressure versus rate. To determine the fracture initiation flow point, the friction curve and the fracturing curve may be compared. The first point on the fracturing curve as flow rate of the annulus fluid increases where the slope of the fracturing curve is less than or equal to the slope of the corresponding point on the friction curve is the fracture initiation flow point on the annulus fluid flow axis, while the associated annulus pressure is defined on the annulus pressure axis. As one of ordinary skill in the art will appreciate, the above method for determining the fracture initiation flow point may be performed without plotting the data by use of methodologies known to those skilled in the art. For example, conventional methodologies may be used to compare the measured annulus pressure and flow rate of the annulus fluid to the friction curve. Once obtained the fracture initiation flow point may be used to initiate a fracture tip screenout on demand. Initiation of a fracture tip screenout will be discussed in more detail below. Further, the fracture initiation flow point may be useful when fracturing a different portion of subterranean formation 106, as it indicates the approximate fracture gradient of the region and provides an estimate of the minimum fracture initiation flow point. It is a minimum fracture initiation flow point because there is a new fluid loss point, the fracture just created.

Figure 4:
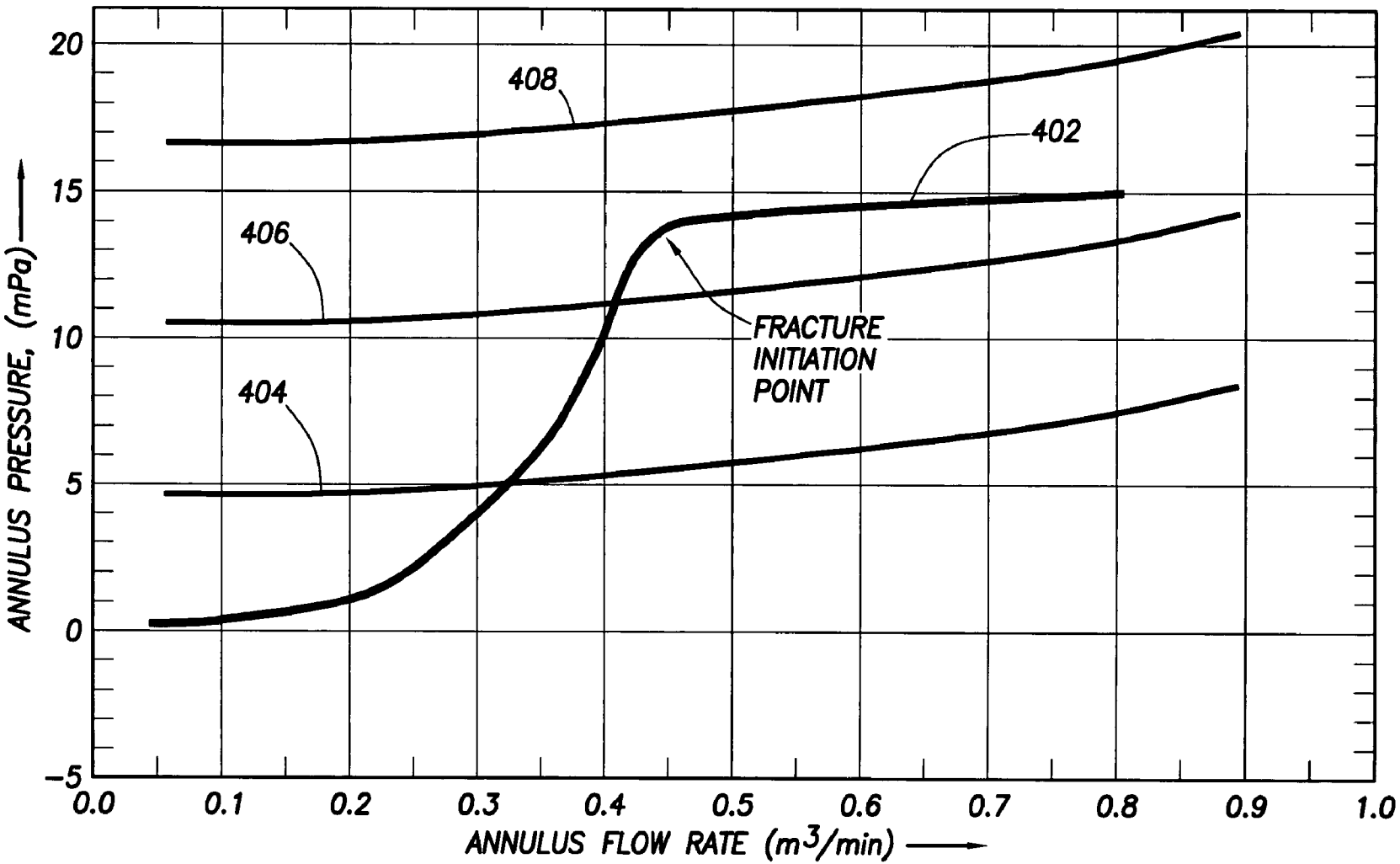
FIG. 4 is a graphical representation of a fracturing curve and friction curve(s) for determining the fracture initiation flow point in accordance with an embodiment of the present invention.

Referring now to FIG. 4, depicted is a graphical representation of three friction curves and fracturing curve 402 for a hypothetical fracturing operation. Each of the three friction curves are based on different expected fracture pressures based on the estimated fracture gradient of the formation. First friction curve 404 is based on an expected low predication. Second friction curve 406 is based on an expected medium prediction. Third friction curve 408 is based on an expected high prediction. Fracturing curve 402 is a plot of annulus pressure versus flow rate of the annulus fluid for a hypothetical fracturing operation. To determine the fracture initiation flow point, fracturing curve 402 may be compared to the three friction curves. As previously discussed, the fracture initiation flow point is the first point with increasing flow rate of the annulus fluid where the slope of fracturing curve 402 is equal to or less than the corresponding point on the friction curves. The fracture initiation flow point in FIG. 4 was determined to be about 0.45 cubic meters per minute. And the corresponding annulus pressure at the fracture initiation flow point was about 14 MPa.

According to the methods of the present invention, the physical property data may be sensed using any suitable technique. The physical property data may comprise an annulus pressure and an annulus flow rate. In some embodiments, the data is obtained at the surface, e.g., from the pumping equipment. In general, any sensing technique and equipment suitable for detecting the desired physical property data with adequate sensitivity and/or resolution may be used.

Figure 5:
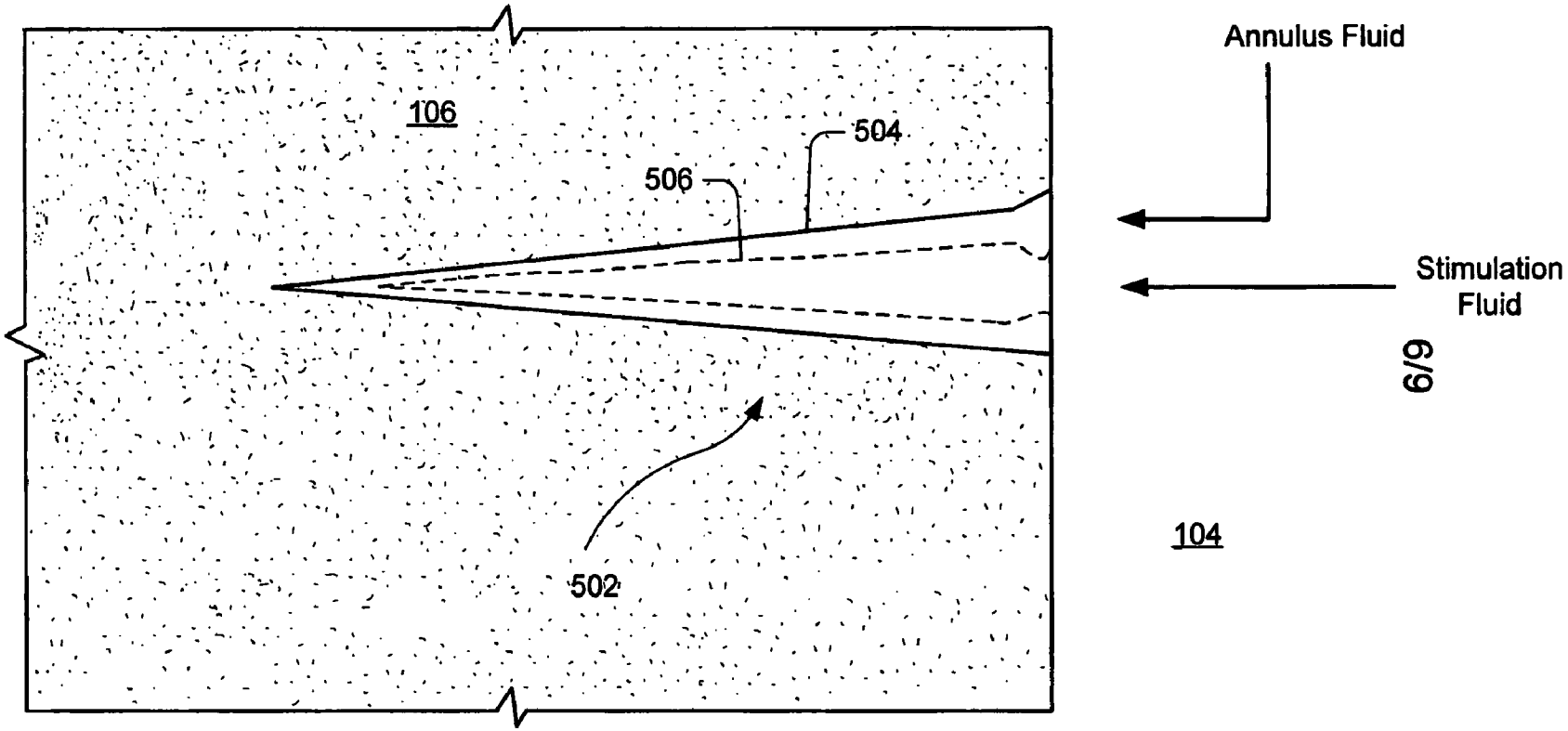
FIG. 5 and FIG. 6 are schematic diagrams illustrating the initiation of a fracture tip screenout in accordance with an embodiment of the present invention.

Referring now to FIG. 5, a schematic diagram is shown illustrating a fracture 502 that has been created in subterranean formation 106 using the above-described methods. Stimulation fluid enters fracture 502 via jetting tool 110 (shown in FIGS. 1A and 1B)). Annulus fluid pumped into annulus 114 (shown in FIGS. 1A and 1B)) between an subterranean formation 106 and work string 108 also may enter fracture 502 due to the pressure decreases surrounding the entrance to fracture 502 due to the Bernoulli effect created by the jetting of the stimulation fluid into fracture 502.

At the end of the fracturing operation, it may be desired to initiate a fracture tip screenout, for example, to terminate the extension of fracture 502 into subterranean formation 106 and generate sufficient fracture width. Fracture 502 has a fracture face in first position 504 prior to initiation of a fracture tip screenout. To create a fracture tip screenout, the flow rate should be reduced below the fracture initiation flow point. In some embodiments, the annulus flow rate should be reduced below the fracture initiation flow point. The concentration of proppant in the stimulation fluid that is jetted into the one or more fractures may be increased simultaneously to reducing the annulus flow rate below the fracture initiation flow point, but an increase in proppant concentration may not be necessary to initiate a fracture tip screenout in accordance with the methods of the present invention. One of ordinary skill in the art will appreciate that the annulus flow rate should not be reduced below the rate necessary to maintain the pressure above the pressure within the formation matrix, so that fluid can be squeezed into the formation matrix inside fracture 502, so that the annulus fluid and/or stimulation fluid continues to enter fracture 502. As the annulus flow rate is reduced below the fracture initiation flow point, the pressure reductions surrounding fracture 502 caused by the Bernoulli effect caused by the jetting of the stimulation fluid cause an instantaneous reduction in the width of fracture 502 so that the fracture face is now in second position 506. It is believed that when the annulus flow rate drops below the fracture initiation flow point an instantaneous fracture tip screenout may occur. Because the fracture tip screenout is instantaneous, there is an immediate increase in annulus pressure when the annulus flow rate is reduced below the fracture initiation flow point.

Figure 6:
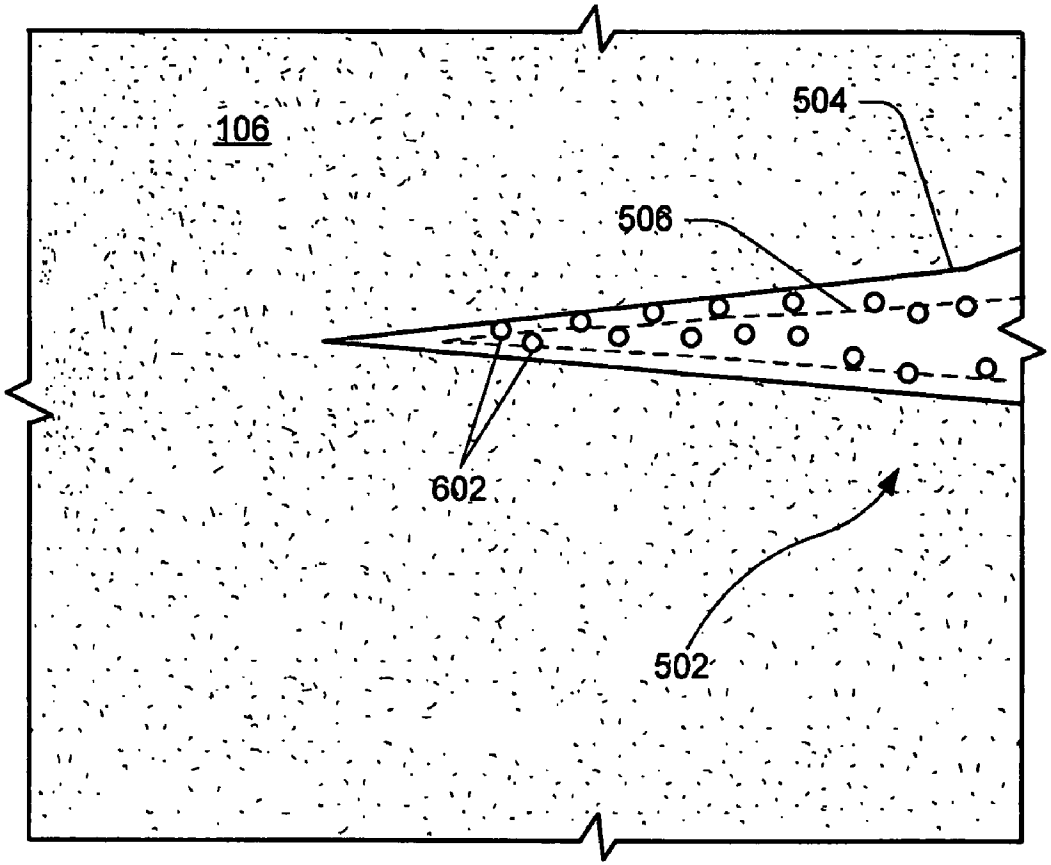

Referring now to FIG. 6, a schematic diagram is shown illustrating the tip of fracture 502. Proppant 602 is shown disposed in fracture 502. Proppant 602 is suspended in the stimulation fluid jetted into fracture 502 and/or the annulus fluid that enters fracture 502. As the stimulation fluid is jetted into fracture 502 and/or the annulus fluid also enters fracture 502 as discussed above, proppant 602 moves further into fracture 502. Fracture 502 has a fracture face in first position 504 prior to initiation of a fracture tip screenout. When the annulus flow rate is reduced below the fracture initiation flow point to initiate a fracture tip screenout, the pressure reductions surrounding the cavity caused by the jetting of a stimulation fluid causes an instantaneous reduction in the width of fracture 502 so that the fracture face is now in its second position 510. The decrease in the width of fracture 502 causes one or more particulates of proppant 602 to be immobilized at the tip of fracture 502. As the one or more particulates of proppant 602 are immobilized, they bridge the narrow gaps at the end of fracture 502 causing a sudden flow restriction in the region. This flow restriction, in turn, causes a higher fluid velocity in the area, which, in turn, causes a pressure drop causing the fracture to close a little further. This bridging and/or immobilization of one or more of the particulates of proppant 602 at the fracture tip result in an instantaneous tip screenout occurs, which, in turn, results in an immediate increase in annulus pressure. As stimulation fluid is continuing to be jetted into fracture 502 and annulus fluid is continued to be pumped into annulus, proppant 602 packs fracture 502.

In some embodiments, an operator may initiate a fracture tip screenout on demand from the surface by controlling (e.g., reducing) the annulus flow rate. The exact timing for the initiation of the fracture tip screenout may vary based on a variety of factors, including the desired fracture geometry and the formation characteristics and conditions. One of ordinary skill in the art with the benefit of this disclosure will be able to determine the appropriate point in the fracturing operation to initiate the fracture tip screenout.

The methods of the present invention may be repeated, as desired, to stimulate (e.g., fracture) multiple portions of the subterranean formation. In some embodiments, jetting tool 110 (depicted on FIGS. 1A and 1B) may be used to fracture a plurality of portions of subterranean formation 106 on a single trip into wellbore 104. For example, once the fracture tip screenout has occurred stimulation system 102 (depicted in FIGS. 1A and 1B) may be moved to another portion of subterranean formation 106 to be stimulated, and the above procedure may be repeated to achieve the desire stimulation and fracture tip screenout. In these embodiments, the methods of the present invention further comprise moving the jetting tool 110 adjacent to a second portion of subterranean formation 106 to be fractured; jetting a stimulation fluid against the second portion of subterranean formation 106; pumping an annulus fluid into annulus 114 at an annulus flow rate at or above the fracture initiation flow point so that one or more fractures are created in the second portion of subterranean formation 106; and reducing the annulus flow rate below a fracture initiation flow point so that the fracture tip screenout is initiated in one or more fractures in the second portion of subterranean formation 106.

In one embodiment, the present invention provides a method of initiating a fracture tip screenout in one or more fractures in a subterranean formation, comprising pumping an annulus fluid into an annulus, between the subterranean formation and a work string disposed within a wellbore penetrating the subterranean formation, at an annulus flow rate; and reducing the annulus flow rate below a fracture initiation flow point so that the fracture tip screenout is initiated in the one or more fractures in the subterranean formation.

In another embodiment, the present invention provides a method of fracturing a portion of a subterranean formation comprising jetting a stimulation fluid against the portion of the subterranean formation; pumping an annulus fluid into an annulus, between the subterranean formation and a work string disposed within a wellbore penetrating the subterranean formation, at an annulus flow rate at or above the fracture initiation flow point so that one or more fractures are created in the portion of the subterranean formation; and reducing the annulus flow rate below a fracture initiation flow point so that a fracture tip screenout is initiated in the one or more fractures in the portion of the subterranean formation.

In yet another embodiment, the present invention provides a method of estimating a fracture initiation flow point comprising measuring an annulus flow rate of an annulus fluid over time; measuring an annulus pressure of the annulus fluid over time; determining a fracture initiation flow point based on the annulus flow rate and the annulus pressure.

To facilitate a better understanding of the present invention, the following examples of certain embodiments are given. In no way should the following examples be read to limit, or define, the scope of the invention.

EXAMPLE 1

This example provides a hypothetical example to illustrate the initiation of a fracture tip screenout in accordance with an embodiment of the present invention. The hypothetical fracturing operation involves the co-injection of an annulus fluid with the jetting of a stimulation fluid against the portion of the subterranean formation to be fractured.

Figure 7:
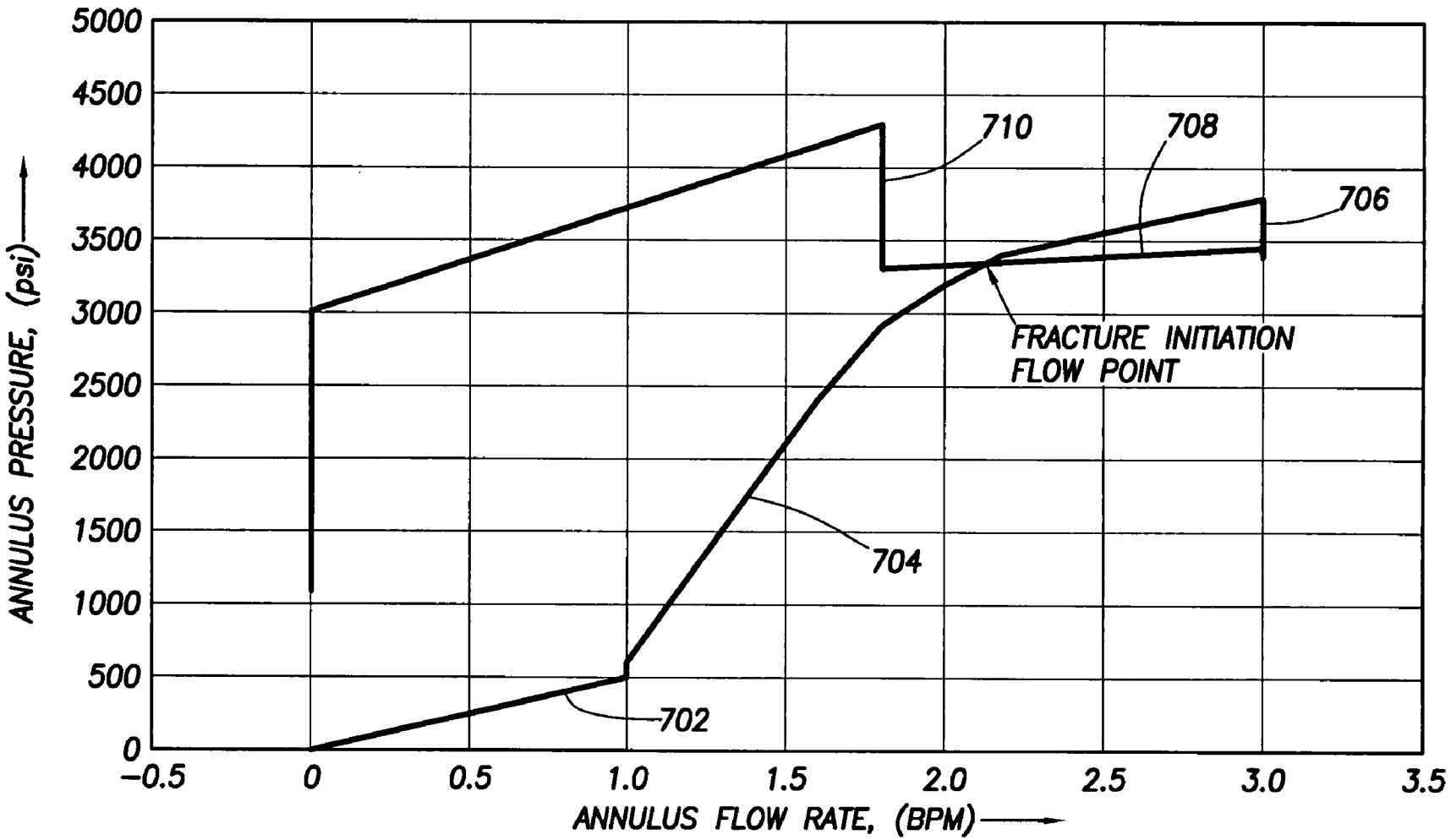
FIG. 7 is a graphical representation of a fracturing curve for a hypothetical fracturing operation in accordance with an embodiment of the present invention.
Figure 8:
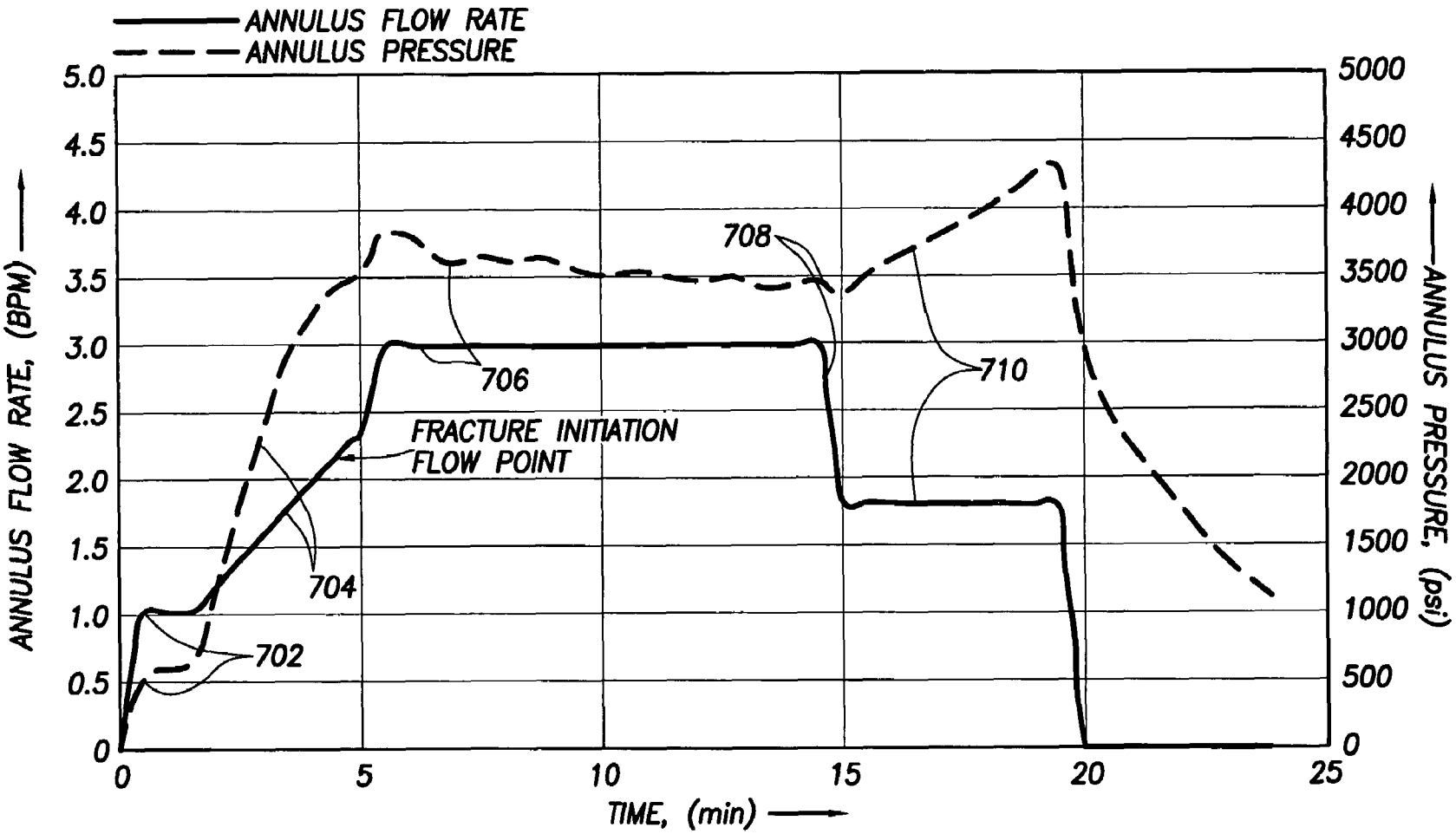
FIG. 8 is a graphical representation of annulus pressure and annulus flow rate versus time for a hypothetical fracturing operation in accordance with an embodiment of the present invention.

FIG. 7 is a fracturing curve that is a plot of annulus pressure versus annulus flow rate for this hypothetical example. FIG. 8 is a plot of annulus pressure and annulus flow rate versus time for this hypothetical example. The data in both FIG. 7 and FIG. 8 is plotted at 30-second intervals.

Referring now to FIG. 7 and FIG. 8, as represented by reference number 702, the annulus flow rate is first increased from 0 barrels per minute ("BPM") to about 1 BPM, as indicated by reference number 702, during an initial wellbore filling process. Next, the annulus flow rate is steadily increased from about 1 BPM to about 3 BPM in about 3 minutes to initiate a fracture, as indicated by reference number 704. As previously discussed, the fracture initiation flow point on fracturing curve is the first point on the fracturing curve where the slope of the fracturing curve is less than or equal to the slope on the corresponding point on a friction curve. A friction curve is not shown, but the fracture initiation flow point would likely occur at about 2.2 BPM. This correlates to an annulus pressure of about 3,300 psi at the fracture initiation flow point. Next, the annulus flow rate is held constant at about 3 BPM for about 10 minutes, as indicated by reference number 706, for the fracturing process to extend and enlarge the fracture that was initiated in the formation. Next, to initiate a fracture tip screenout the annulus flow rate is reduced to a flow rate below the previously determined fracture initiation flow point of about 2.2 BPM. Accordingly, to initiate a fracture tip screenout the annulus flow rate is reduced from about 3 BPM to about 1.8 BPM, as indicated by reference number 708. When the annulus flow rate drops below the fracture initiation flow point, there is an almost instantaneous increase in annulus pressure indicating the occurrence of a fracture tip screenout. This is seen from the steady annulus pressure increase when annulus flow rate is held constant at about 1.8 BPM for about 5 minutes, as indicated by reference number 710. Once the fracture is sufficiently packed, the annulus flow rate is reduced to about 0 BPM.

EXAMPLE 2

Table 2, below, lists an exemplary fracturing schedule, wherein the annulus pressure may be reduced to induce a fracture tip screenout. The exemplary fracturing schedule is for a cased wellbore, wherein the casing is cemented to the subterranean formation.

TABLE 1

| Stage | Stimulation Fluid Volume (gal) | Stimulation Fluid Proppant Concentration (lb/gal) | Jetting Pressure (psi) | Stimulation Fluid Flow Rate (BPM) | Annulus Flow Rate (BPM) |
|---|---|---|---|---|---|
| Jetting | 2500 | 1.0 | 3,427 | 11 | 3.476 |
| Pad | 681 | 0.25 | 3,898 | 10 | 3.476 |
| Slurry1 | 909 | 4.95 | 4,867 | 10 | 3.476 |
| Slurry2 | 284 | 8.80 | 5,440 | 10 | 3.476 |
| Flush1 | 2050 | 0.00 | 2,663 | 10 | 3.476 |
| End Flush | 200 | 0.00 | 4,407 | 9 | 3.100 |
| Total | 6624 gal | 6998.65 lbs | Stimulation Fluid Dilution | 10.00% | |

In the embodiment described in Table 1, a fracturing operation begins with a jetting stage. In the jetting stage, 2500 gallons of a stimulation fluid with a proppant concentration of 1 pound per gallon ("lb/gal") is pumped down a work string at 11 barrels per minute ("BPM") and jetted through a jetting tool against the interior surface of the casing at a jetting pressure of 3,427 pounds per square inch ("psi"). Once the stimulation fluid perforates the casing and cement sheath, the stimulation fluid is jetted through the perforations in the casing and cement sheath and against the portion of the subterranean formation to be fractured to form cavities therein. Simultaneously, an annulus fluid is pumped into the annulus at an increasing flow rate from 0 BPM to a flow rate of 3.476 BPM. In this stage, the stimulation fluid creates cavities in the wall of the wellbore. The stimulation fluid dilution of 10% represents that it is expected that 10% of the fluid that enters the cavities will be the annulus fluid.

The next stage in the fracturing operation is the pad. In the pad, 681 gallons of the stimulation fluid is pumped down a work string at 10 BPM and jetted through the jetting tool into the cavities against the subterranean formation at a jetting pressure of 3,898 psi. The concentration of the proppants in the stimulation fluid is reduced to 0.25 lb/gal and the flow rate of the annulus fluid is constant at 3.476 BPM. During the pad, the cavities formed during the jetting stage are extended into the subterranean formation.

After the pad, the proppant concentration in the stimulation fluid is increased. In slurry1, the concentration of proppants is increased to 4.95 lb/gal and 909 gallons of stimulation fluid is pumped down the work string at 10 BPM and jetted into the cavities against the formation at a jetting pressure of 4,867 psi. In slurry2, the proppant concentration is increased to 8.80 lb/gal, and 284 gallons of the stimulation fluid is pumped down the work string at 10 BPM and jetted into the cavities against the formation at a jetting pressure of 5,440 psi. In slurry1 and slurry 2, the flow rate of the annulus fluid remains at 3.476 BPM.

After the slurry2, a flush stage is initiated. In the flush stage, the proppant concentration in the stimulation fluid is reduced to 0 lb/gal. During the flush stage, 2050 gallons of the stimulation fluid is pumped down the work string at 10 BPM and jetted into the cavities against the formation at a jetting pressure of 2,663 psi. The flow rate of the annulus fluid remains constant. Following the flush stage, an End Flush is performed. In the End Flush, 200 gallons of the stimulation fluid is pumped down the work string at 9 BPM and jetted into the cavities against the formation at a jetting pressure of 4407 psi. In this stage, the flow rate of the annulus fluid is reduced to 3.100 BPM, below the expected fracture initiation flow point. This flow rate of the annulus fluid is reduced to no more than the fracture initiation flow point so that an instantaneous fracture tip screenout will occur. The volume of the stimulation fluid used in the flush and End Flush stages should be sufficient to force all the proppant from the prior stages out of the work string.

Therefore, the present invention is well adapted to carry out the objects and attain the ends and advantages mentioned as well as those which are inherent therein. While numerous changes may be made by those skilled in the art, such changes are encompassed within the spirit of this invention as defined by the appended claims.

What is claimed is:

1. A method of initiating a fracture tip screenout in one or more fractures in a subterranean formation, comprising:

pumping an annulus fluid into an annulus, between the subterranean formation and a work string disposed within a well bore penetrating the subterranean formation, at an annulus flow rate;

determining the fracture initiation flow point, wherein determining the fracture initiation flow point comprises measuring the annulus flow rate of the annulus fluid over time and measuring an annulus pressure of the annulus fluid over time; and reducing the annulus flow rate below a fracture initiation flow point so that the fracture tip screenout is initiated in one or more fractures in the subterranean formation.

2. The method of claim 1 wherein the initiation of the fracture tip screenout is instantaneous when the annulus flow rate is reduced below the fracture initiation flow point.

3. The method of claim 1 wherein an annulus pressure of the annulus fluid increases subsequent to reducing the annulus flow rate below the fracture initiation point.

4. The method of claim 1 wherein the fracture tip screenout is initiated at the surface by an operator controlling the annulus flow rate.

5. The method of claim 1 wherein determining the fracture initiation flow point further comprises comprising plotting a fracturing curve of the annulus pressure versus the annulus flow rate.

6. The method of claim 5 wherein determining the fracture initiation flow point further comprises plotting a friction curve based on the annulus fluid and a geometry of the work string.

7. The method of claim 6 wherein the friction curve is a plot of an annulus pumping pressure at a constant downhole pressure.

8. The method of claim 6 wherein determining the fracture initiation flow point further comprises comparing the friction curve and the fracturing curve.

9. The method of claim 8 wherein the fracture initiation flow point is a first point on the fracturing curve as annulus flow rate increases where a slope of the fracturing curve is less than or equal to a slope of a corresponding point on the friction curve.

10. The method of claim 1 wherein the annulus fluid is a water-based fluid or an oil-based fluid.

11. The method of claim 10 wherein the annulus fluid is a linear gel or a crosslinked gel.

12. The method of claim 10 wherein the annulus fluid comprises proppant.

13. The method of claim 10 wherein the annulus fluid is foamed.

14. The method of claim 1 further comprising jetting a stimulation fluid into the one or more fractures in the subterranean formation.

15. The method of claim 14 wherein the stimulation fluid is the same as the annulus fluid.

16. The method of claim 14 further comprising positioning a jetting tool adjacent to a portion of the subterranean formation to be fractured, wherein the jetting tool has a plurality of ports therein.

17. The method of claim 16 further comprising jetting the stimulation fluid through the plurality of ports at a pressure sufficient to create cavities in the portion of the subterranean formation to be fractured.

18. The method of claim 17 wherein the annulus flow rate is at or above a fracture initiation flow point so that a pressure in the annulus plus a pressure in the cavities is at or above a pressure sufficient to enhance the cavities, thereby creating one or more fractures in the portion of the subterranean formation to be fractured.

19. The method of claim 14 wherein a portion of the annulus fluid is mixed with the stimulation fluid.

20. The method of claim 14 wherein the stimulation fluid is a water-based fluid or an oil-based fluid.

21. The method of claim 14 wherein the stimulation fluid is a linear gel or a crosslinked gel.

22. The method of claim 14 wherein the stimulation fluid comprises proppant.

23. The method of claim 22 further comprising increasing a concentration of the proppant in the stimulation fluid that is jetted into the one or more fractures simultaneous to reducing the annulus flow rate below the fracture initiation flow point.

24. The method of claim 14 wherein the stimulation fluid is foamed.

25. The method of claim 1 wherein a casing is disposed within the well bore.

26. A method of fracturing a portion of a subterranean formation comprising:

jetting a stimulation fluid against the portion of the subterranean formation;

pumping an annulus fluid into an annulus, between the subterranean formation and a work string disposed within a well bore penetrating the subterranean formation, at an annulus flow rate at or above the fracture initiation flow point so that one or more fractures are created in the portion of the subterranean formation; and reducing the annulus flow rate below a fracture initiation flow point so that a fracture tip screenout is initiated in the one or more fractures in the portion of the subterranean formation.

27. The method of claim 26 wherein the initiation of the fracture tip screenout is instantaneous when the annulus flow rate is reduced below the fracture initiation flow point.

28. The method of claim 26 wherein an annulus pressure of the annulus fluid increases subsequent to reducing the annulus flow rate below the fracture initiation point.

29. The method of claim 26 wherein the fracture tip screenout is initiated at the surface by an operator controlling the annulus flow rate.

30. The method of claim 26 further comprising determining the fracture initiation flow point.

31. The method of claim 30 wherein determining the fracture initiation flow point comprises measuring the annulus flow rate of the annulus fluid over time.

32. The method of claim 31 wherein determining the fracture initiation flow point further comprises measuring an annulus pressure of the annulus fluid over time.

33. The method of claim 32 wherein determining the fracture initiation flow point further comprises comprising plotting a fracturing curve of the annulus pressure versus the annulus flow rate.

34. The method of claim 33 wherein determining the fracture initiation flow point further comprises plotting a friction curve based on the annulus fluid and a geometry of the work string.

35. The method of claim 34 wherein the friction curve is a plot of an annulus pumping pressure at a constant downhole pressure.

36. The method of claim 34 wherein determining the fracture initiation flow point further comprises comparing the friction curve and the fracturing curve.

37. The method of claim 36 wherein the fracture initiation flow point is a first point on the fracturing curve as annulus flow rate increases where a slope of the fracturing curve is less than or equal to a slope of a corresponding point on the friction curve.

38. The method of claim 32 wherein determining the fracture initiation flow point further comprises determining the fracture initiation flow point based on the annulus flow rate and the annulus pressure.

39. The method of claim 26 wherein the annulus fluid is a water-based fluid or an oil-based fluid.

40. The method of claim 26 wherein the annulus fluid is a linear gel or a crosslinked gel.

41. The method of claim 26 wherein the annulus fluid comprises proppant.

42. The method of claim 26 wherein the annulus fluid is foamed.

43. The method of claim 26 further comprising positioning a jetting tool adjacent to a portion of the subterranean formation to be fractured, wherein the jetting tool has a plurality of ports therein.

44. The method of claim 43 wherein the jetting tool is used to fracture a plurality of portions of the subterranean on a single trip into the well bore.

45. The method of claim 43 further comprising:

moving the jetting tool adjacent to a second portion of the subterranean formation to be fractured;

jetting a stimulation fluid against the second portion of the subterranean formation;

pumping an annulus fluid into the annulus at an annulus flow rate at or above the fracture initiation flow point so that one or more fractures are created in the second portion of the subterranean formation; and reducing the annulus flow rate below a fracture initiation flow point so that a fracture tip screenout is initiated in the one or more fractures in the second portion of the subterranean formation.

46. The method of claim 43 further comprising jetting the stimulation fluid through the plurality of ports at a pressure sufficient to create cavities in the portion of the subterranean formation to be fractured.

47. The method of claim 46 wherein the annulus flow rate is at or above a fracture initiation flow point so that a pressure in the annulus plus a pressure in the cavities is at or above a pressure sufficient to enhance the cavities, thereby creating one or more fractures in the portion of the subterranean formation to be fractured.

48. The method of claim 26 wherein a portion of the annulus fluid is mixed with the stimulation fluid.

49. The method of claim 26 wherein the stimulation fluid is a water-based fluid or an oil-based fluid.

50. The method of claim 26 wherein the stimulation fluid is a linear gel or a crosslinked gel.

51. The method of claim 26 wherein the stimulation fluid comprises proppant.

52. The method of claim 26 further comprising increasing a concentration of the proppant in the stimulation fluid that is jetted into the one or more fractures simultaneous to reducing the annulus flow rate below the fracture initiation flow point.

53. The method of claim 26 wherein the stimulation fluid is foamed.

54. The method of claim 26 wherein the stimulation fluid is the same as the annulus fluid.

55. The method of claim 26 wherein a casing is disposed within the well bore.

56. A method of estimating a fracture initiation flow point comprising:

measuring an annulus flow rate of an annulus fluid over time;

measuring an annulus pressure of the annulus fluid over time;

determining a fracture initiation flow point based on the annulus flow rate and the annulus pressure; and performing a subterranean treatment based, at least in part, on the fracture initiation flow point.

57. The method of claim 56 wherein the annulus fluid is pumped into an annulus formed between a subterranean formation and a work string disposed within a well bore penetrating the subterranean formation.

58. The method of claim 56 wherein determining the fracture initiation flow point further comprises comprising plotting a fracturing curve of the annulus pressure versus the annulus flow rate.

59. The method of claim 58 wherein determining the fracture initiation flow point further comprises plotting a friction curve based on the annulus fluid and a geometry of the work string.

60. The method of claim 59 wherein the friction curve is a plot of an annulus pumping pressure at a constant downhole pressure.

61. The method of claim 59 wherein determining the fracture initiation flow point further comprises comparing the friction curve and the fracturing curve.

62. The method of claim 61 wherein the fracture initiation flow point is a first point on the fracturing curve as annulus flow rate increases where a slope of the fracturing curve is less than or equal to a slope of a corresponding point on the friction curve.

* * * * *